United States Patent [19]

Nakano et al.

[11] Patent Number: 5,007,341

[45] Date of Patent: Apr. 16, 1991

[54] KEYLESS PRINTING PRESS

[75] Inventors: Takafumi Nakano; Akikazu Seo, both of Mihara; Hiromitsu Soeda; Kazufumi Sueoka, both of Hiroshima, all of Japan

[73] Assignees: Mitsubishi Jukogyo Kabushiki Kaisha, Tokyo; Ryomei Engineering Co., Ltd., Hiroshima, both of Japan

[21] Appl. No.: 397,655

[22] Filed: Aug. 23, 1989

[30] Foreign Application Priority Data

Aug. 23, 1988 [JP] Japan ..... 63-109547

[51] Int. Cl.[5] ..... B41F 31/08

[52] U.S. Cl. ..... 101/349; 101/148

[58] Field of Search ..... 101/157, 348, 365, 349, 101/148

[56] References Cited

U.S. PATENT DOCUMENTS

| | | | |
|---|---|---|---|
| 3,044,396 | 7/1962 | Aller | 101/157 |
| 3,236,178 | 2/1966 | Worthington et al. | 101/365 |
| 4,009,657 | 3/1977 | Bonanno et al. | 101/157 |
| 4,690,055 | 9/1987 | Fadner et al. | 101/350 |
| 4,838,164 | 6/1989 | Miyoshi et al. | 101/365 |
| 4,864,925 | 9/1989 | Van Kanegan et al. | 101/141 |

FOREIGN PATENT DOCUMENTS

| | | | |
|---|---|---|---|
| 0199520 | 10/1986 | European Pat. Off. . | |
| 722236 | 5/1942 | Fed. Rep. of Germany | 101/157 |
| 163857 | 7/1986 | Japan . | |

*Primary Examiner*—Edgar S. Burr
*Assistant Examiner*—John S. Hilten
*Attorney, Agent, or Firm*—Wenderoth, Lind & Ponack

[57] ABSTRACT

A keyless printing press includes a delivery nozzle disposed in opposition to an ink source roller and provided with a plurality of delivery ports aligned in parallel along the axial direction of the ink source roller. Printing ink circulating through an ink circulation system is delivered and fed through the respective delivery ports of the delivery nozzle to the ink source roller. The arrangement is improved to obviate the shortcoming that isolated water may repeatedly circulate through the ink circulation system and accumulate, resulting in lowering of printing depth. At least one ink outflow port, for ensuring that printing ink having a high moisture content proportion will flow out of the delivery nozzle, is provided in the delivery nozzle at a position at a level higher than any of the delivery ports.

14 Claims, 5 Drawing Sheets

FIG. 3

KEYLESS PRINTING PRESS

BACKGROUND OF THE INVENTION

1. Field of the Invention

The present invention relates to a ink delivery nozzle in a keyless printing press, in which ink keys provided in a doctor of an ink source roller are omitted.

2. Prior Art

One example of a keyless printing press in the prior art is shown in FIGS. 13 to 16. In FIG. 16 which shows a general construction of the keyless printing press, reference numeral 1 designates an ink reservoir, numeral 2 designates a suction pipe, numeral 3 designates a pump, numeral 4 designates a delivery pipe, numeral 5 designates a delivery nozzle, numeral 6 designates an ink feed doctor, numeral 7 designates an ink source roller, numeral 8 designates a transfer roller, numeral 9 designates a doctor roller, numeral 10 designates an anti-hysteresis doctor, numerals 11 and 12 designate ink application rollers, numeral 13 designates a wetting device, numeral 14 designates a plate drum, numeral 15 designates a blanket drum, numeral 16 designates a paper sheet to be printed, numeral 17 designates an ink feed pipe for feeding ink to the above-mentioned ink reservoir 1, and numeral 18 designates an ink circulation system. In addition, in FIGS. 13 to 15 which show details of the above-mentioned delivery nozzle 5, reference numeral 20 designates a delivery nozzle main body opposed to the above-mentioned ink source roller 7 with a minute gap clearance maintained therebetween, numeral 20 designates a cap for closing a top opening of the same delivery nozzle main body 20, numerals 22 designate inlet pipes provided at the bottom of the same delivery nozzle main body 20, numeral 23 designates a plurality of delivery ports provided in the above-mentioned cap 21, which delivery ports align along the axial direction of the ink source roller 7, and printing ink within the ink reservoir is sent under pressure into the delivery nozzle main body 20 of the delivery nozzle 5 through the route of the suction pipe 2→ the pump 3→ the delivery pipe 4→ the inlet pipes 22, and the ink sent under a pressure into the delivery nozzle main body 20 is delivered and fed to the ink source roller 7 rotating at a low speed through the respective delivery ports 23. Then, the printing ink delivered and fed to the ink source roller 7 rotates and moves jointly with the ink source roller 7 towards the ink feed doctor 6, it is metered into a predetermined thickness by passing through a minute gap clearance between the ink source doctor 7 and the ink feed doctor 6, and surplus printing ink drops and returns to the ink reservoir 1. On the other hand, the printing ink having passed through the minute gap clearance between the ink sourc roller 7 and the ink feed doctor 6 is transferred to the transfer roller 8 which is rotating at a high speed while held in contact with the ink source roller 7. Subsequently, the ink is fed to the plate drum 14 through the route of the doctor roller (the doctor roller having an ink film of uniform thickness formed thereon by the anti-hysteresis doctor 10) 9→ ink application rollers 11 and 12. In addition, at this time, wetting water is fed from the wetting device 13 to the plate drum 14. To a pattern portion of this plate drum 14 will adhere printing ink, while to a non-pattern portion will adhere wetting water, whereby a predetermined ink film image is formed. This ink film image is transferred to the sheet 16 to be printed via the blanket drum 15, and thus printing is effected.

However, the keyless printing press in the prior art as described above with reference to FIGS. 13 to 16 involves the following problems. That is, in the printing ink scraped out by the anti-hysteresis doctor 10 and dropping in the ink reservoir 1 is contained wetting water of about 20–30%, so that such wetting water enters the ink reservoir 1, in addition to fresh ink fed through an ink feed pipe 17. Since the wetting water has a smaller specific gravity than the printing ink, very fine water drops of the wetting water in the ink reservoir 1 will float up through the printing ink layer in the ink reservoir 1, will accumulate on the surface of the printing ink, and will become isolated water. This isolated water has a smaller viscosity than the printing ink, hence it more easily flows, and preferentially flows through ink circulation system 18. Even after such isolated water is delivered through the delivery nozzle 5, it will hardly adhere to the ink source roller 7 (its surface is covered by an ink film and has a strong lipophilic property) but will drop again into the ink reservoir 1. Consequently, there is the problem that the isolated water will repeatedly circulate through the ink circulation system 18 and will be successively accumulated. If such accumulation should exceed a predetermined limit, the amount of adhesion of the ink to the ink source roller 7 will become insufficient or transfer of ink to the transfer roller 8 will not be satisfactory, resulting in lowering of a printing depth.

SUMMARY OF THE INVENTION

The present invention has been proposed in view of the above-described problem in the prior art, and it is one object of the present invention to provide an improved keyless printing press which can prevent lowering of printing depth caused by accumulation of wetting water in printing ink.

According to one feature of the present invention, there is provided a novel keyless printing press including a delivery nozzle disposed in opposition to an ink source roller and provided with a plurality of delivery ports aligned in parallel along the axial direction of the ink source roller so that printing ink circulating through an ink circulation system may be delivered and fed through the respective delivery ports of the delivery nozzle to the ink source roller. An ink outflow port, for ensuring that printing ink within the delivery nozzle will flow out of the delivery nozzle, is provided in the delivery nozzle at a position at a level higher than any of the delivery ports. Preferably, the above-featured keyless printing press comprises a recovery container for recovering printing ink flowing out of the ink outflow port. Furthermore, preferably, the keyless printing press includes a return port for returning printing ink to the ink circulation system at a position between the recovery container and the ink outflow port.

According to the present invention, since the keyless printing press is constructed in the abovedescribed manner, and since when a mixture liquid consisting of printing ink and isolated water has flowed into the delivery nozzle, a mixture liquid portion having a high moisture content proportion occupies an upper layer, while a mixture liquid portion having a low moisture content proportion occupies a lower layer. The liquid having a low moisture content proportion will be delivered and fed through the respective delivery ports towards the ink source roller, whereas the mixture liquid having a high moisture content proportion will flow out through the ink outflow port into the recovery container to be taken out to the outside of the ink circulation system. Accordingly, it will never occur that isolated water repeatedly circulates through the ink circulation system and successively accumulates. Thus, there is an advantage that lowering of printing depth can be prevented.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 2:
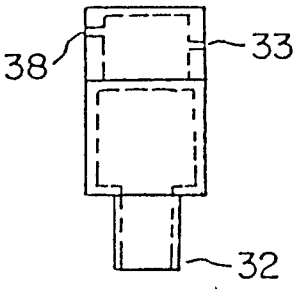
FIG. 2 is a side view thereof.
Figure 4:
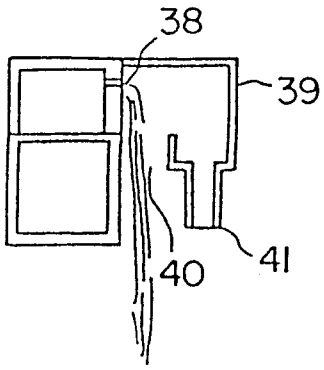
FIG. 4 is a vertical cross-sectional side view of thereof taken along line IV—IV in FIG. 1.
Figure 1:
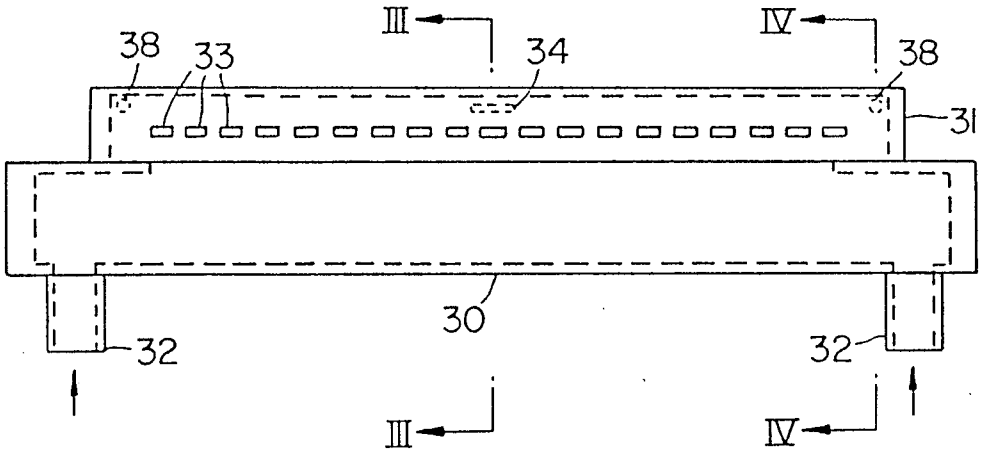
FIG. 1 is a front view showing one preferred embodiment of a delivery nozzle in a keyless printing press according to the present invention.
Figure 3:
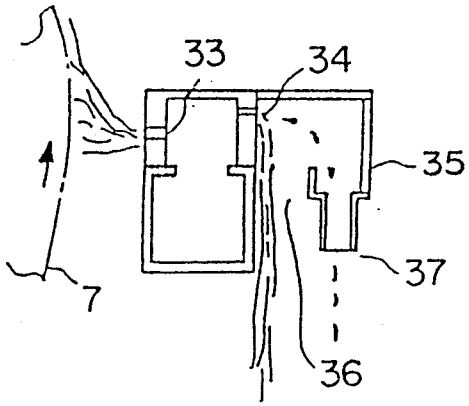
FIG. 3 is a vertical cross-sectional side view thereof taken along line III—III in FIG. 1 as viewed in the direction of the arrows.
Figure 5:
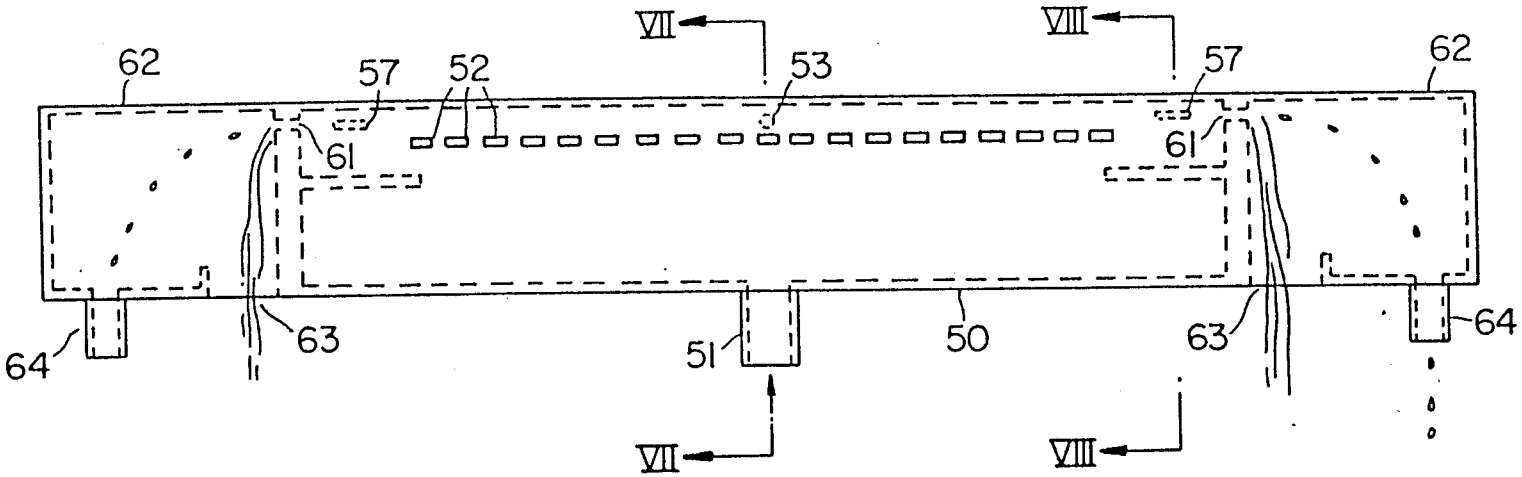
FIG. 5 is a front view showing another preferred embodiment of the present invention.
Figure 8:
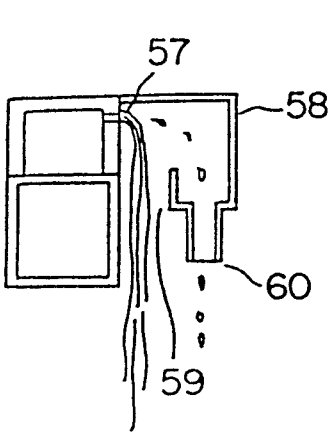
FIG. 8 is a vertical cross-sectional side view thereof taken along line VIII—VIII in FIG. 5 as viewed in the direction of the arrows.
Figure 7:
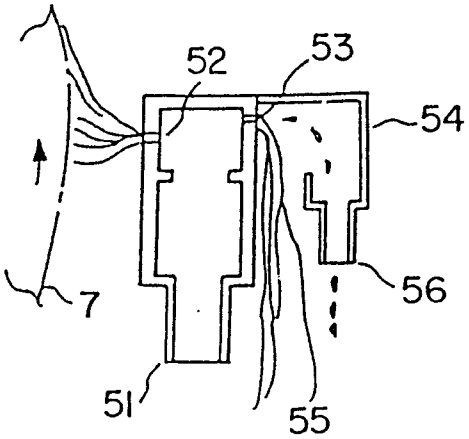
FIG. 7 is a vertical cross-sectional side view thereof taken along line VII—VII in FIG. 5 as viewed in the direction of arrows.
Figure 6:
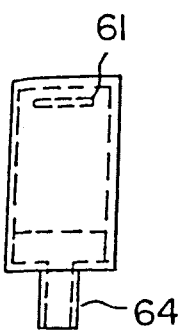
FIG. 6 is a side view thereof.
Figure 9:
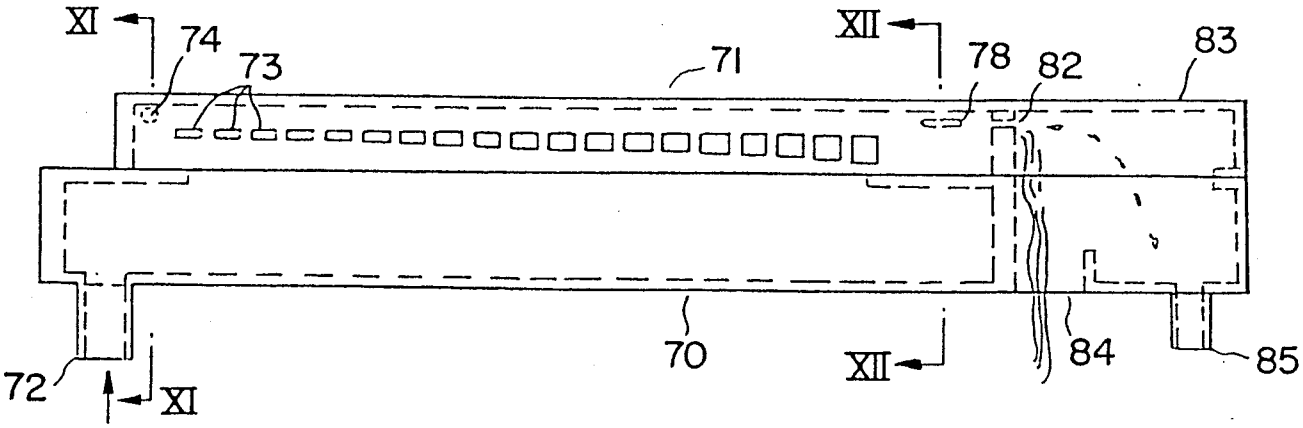
FIG. 9 is a front view showing still another preferred embodiment of the present invention.
Figure 12:
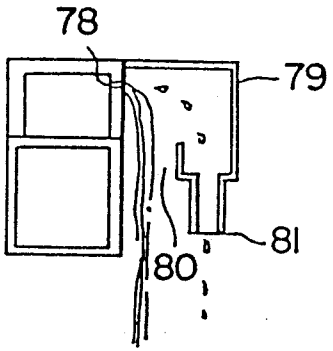
FIG. 12 is a vertical cross-sectional side view taken along line XII—XII in FIG. 9 as viewed in the direction of the arrows.
Figure 11:
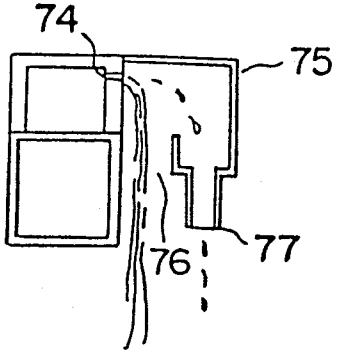
FIG. 11 is a vertical cross-sectional side view taken along line XI—XI in FIG. 9 as viewed in the direction of the arrows.
Figure 10:
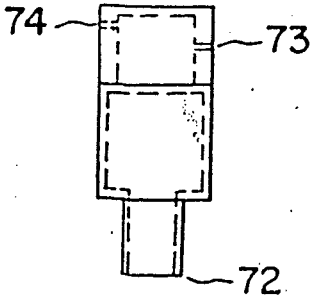
FIG. 10 is a side view thereof.
Figure 13:
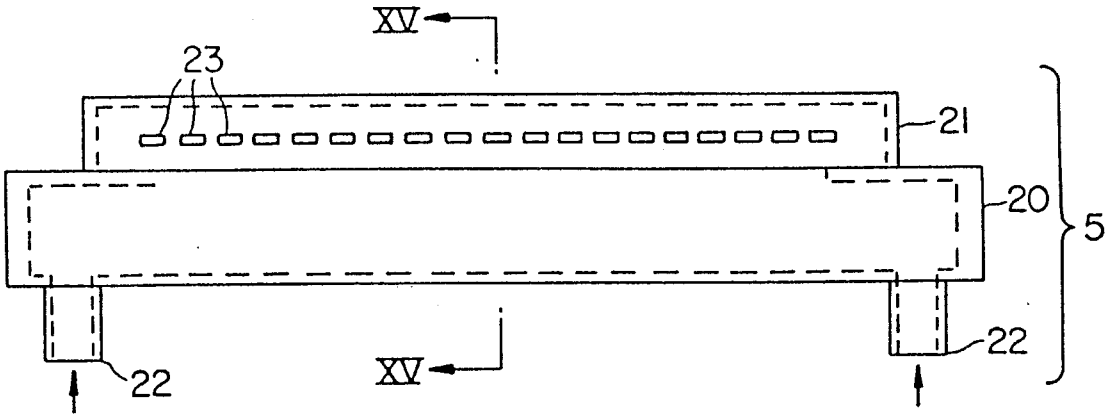
FIG. 13 (PRIOR ART)
FIG. 13 is a front view showing a delivery nozzle in the prior art.
Figure 15:
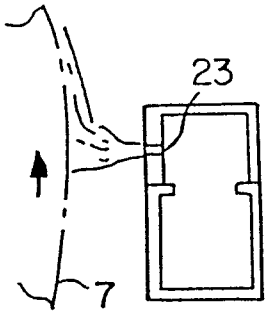
FIG. 15 (PRIOR ART)
FIG. 15 is a vertical cross-sectional side view taken along line XV—XV in FIG. 13 as viewed in the direction of the arrows.
Figure 14:
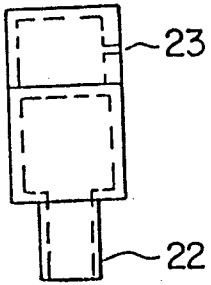
FIG. 14 (PRIOR ART)
FIG. 14 is a side view thereof.

Referring now to FIGS. 1 to 4 which illustrate one preferred embodiment of the present invention, reference numeral 30 designates a delivery nozzle main body of a delivery nozzle, which is disposed in opposition to an ink source roller 7 with a minute gap clearance maintained therebetween. Reference numeral 31 designates a cap for closing a top opening of delivery nozzle main body 30, numerals 32 designate inlet pipes provided at the bottom of the delivery nozzle main body, numeral 33 designates a plurality of delivery ports provided in the front wall of the above-mentioned cap 31, which delivery ports align in one row along the axial direction of the ink source roller 7. Reference numeral 34 designates an ink outflow port provided at the central portion of the rear wall of the cap 31, numerals 38 designate ink outflow ports provided at the respective side portions of the rear wall of the cap 31, and these ink outflow ports 34, 38 are disposed at level higher than any of the delivery ports 33. Reference numeral 35 designates a recovery container provided on the rear side of the cap 31 in opposition to the ink outflow port 34 at the central portion, numeral 36 designates a return flow port provided between the recovery container 35 and the ink outflow port 34 of the delivery nozzle main body 30, and numeral 37 designates a liquid exhaust port provided at the bottom of the recovery container 35. Also numeral 39 designates recovery containers provided on the rear side of the cap 31 in opposition to the ink outflow ports 38 at the respective side or end portions thereof numeral 40 designates return flow ports provided between the recovery containers 39 and the ink outflow ports 38 of the delivery nozzle main body 30, and numeral 41 designates liquid exhaust ports provided at the bottom of the recovery containers 39.

Figure 16:
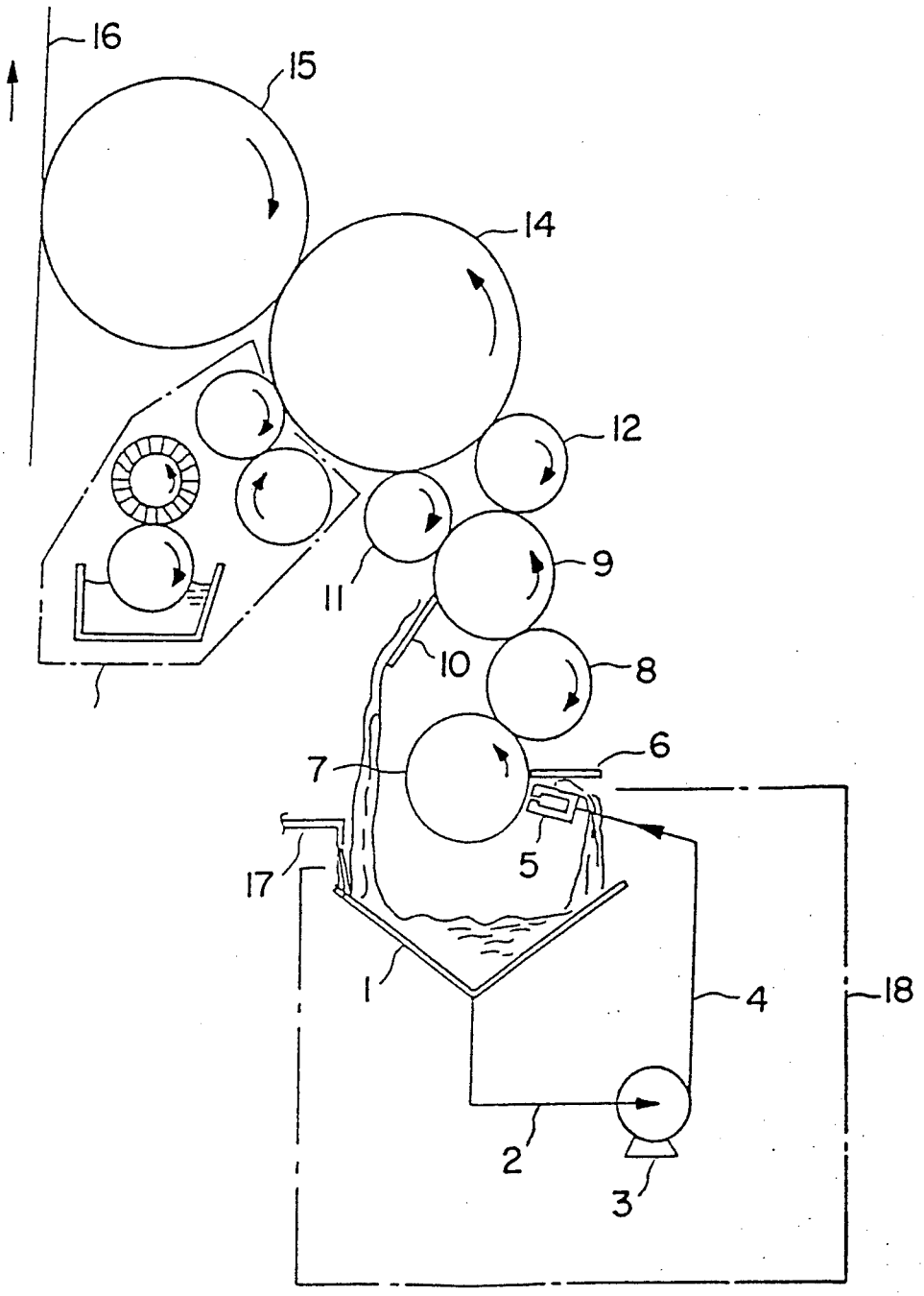
FIG. 16 is a schematic side viewof an entire keyless printing press.

Now operations of the keyless printing press shown in FIGS. 1 to 4 will be explained in detail. A mixture liquid consisting of printing ink and isolated water flows into the cap 31 from the inlet pipes 32 through the delivery nozzle main body 30. At this time, a mixture liquid having a high moisture content proportion occupies an upper layer, while a mixture liquid having a low moisture content proportion occupies a lower layer. Hence the mixture liquid having a low moisture content proportion is delivered and fed through the respective delivery ports 33 towards the ink source roller 7, and on the other hand, the mixture liquid having a high moisture content propor ion flows out through the ink outflow port 34 at the central portion and the ink outflow ports 38 at the respective side or end portions, into the recovery containers 35, 39 respectively. Furthermore, among the mixture liquid having a high moisture content proportion which flows out into the recovery containers 35, 39 a mixture liquid having a relatively low moisture content proportion will drop and return through the return flow ports 36, 40 into an ink reservoir (See the ink reservoir 1 in FIG. 16), and the remaining mixture liquid having a relatively high moisture content proportion will be taken out to the outside of the ink circulation system through the liquid exhaust ports 37, 41.

Next, a keyless printing press according to another preferred embodiment of the present invention will be described with reference to FIGS. 5 to 8. In these figures, reference numeral 50 designates a delivery nozzle main body of a delivery nozzle, which is disposed in opposition to an ink source roller 7 with a minute gap clearance maintained therebetween. Reference numeral 51 designates an inlet pipe provided at the bottom of the center of the delivery nozzle main body 50, numeral 52 designates a plurality of delivery ports provided in the front wall of the delivery nozzle main body 50, and the respective delivery ports 52 align in one row along the axial direction of the ink source roller 7. In addition, reference numeral 53 designates an ink outflow port provided at the central portion of the rear wall of the delivery nozzle main body 50, reference numerals 57 designate ink outflow ports provided at the respective side or end portions of the rear wall of the delivery nozzle main body 50, numerals 61, 61 designate ink outflow ports provided in the respective side or end walls of the delivery nozzle main body, and thes ink outflow ports 53, 57, 61 are disposed at positions at a level higher than the respective delivery ports 52. I addition, reference numeral 54 designates a recovery container provided on the rear side of the delivery nozzle main body 50 opposed to the ink outflow port 53 at the central portion, numeral 55 designates a return flow port provided between the recovery container 54 and the ink outflow port 53 of the delivery nozzle main body 50, and numeral 56 designates a liquid exhaust port provided at the bottom of the recovery container 54. Also numeral 58 designates other recover containers provided on the rear side of the delivery nozzle main body 50 in opposition to the ink outflow ports 57 in the respective side or end portions, numeral 59 designates return flow ports provided between the recovery containers 58 and the ink outflow ports 57 of the delivery nozzle main body 50, and numeral 60 designates liquid exhaust ports at the bottom of the recovery containers 58. Further, numeral 62 designates recovery containers provided on the respective side or end walls of the delivery nozzle main body 50 in opposition to the ink outflow ports 61, numeral 63 designates return flow ports provided between the recovery containers 62 and the ink outflow ports 61 of the delivery nozzle main body 50, and numeral 64 designates liquid exhaust ports provided at the bottom of the recovery containers 62.

Now the operation of the keyless printing press illustrated in FIGS. 5 to 8 will be explained in detail. A mixture liquid consisting of printing ink and isolated water flows into the delivery nozzle main body 50 through the inlet pipe 51. At this moment, since a mixture liquid having a high moisture content proportion occupies an upper layer while a mixture liquid having a low moisture content proportion occupies a lower layer, the mixture liquid having a low moisture content proportion will be delivered and fed through the respective delivery ports 52 towards the ink source roller 7, whereas the mixture liquid having a high moisture content proportion will flow out into the recovery containers 54, 58 and 62 through the ink outflow port 53 at the central portion, the ink outflow ports 57 and 57 at the respective side or end portions of the back wall and the ink outflow ports 61 at the respective end portions. Furthermore, among the mixture liquid having a high moisture content proportion which flows out into the recovery containers 54, 58 and 63, a mixture liquid having a relatively low moisture content proportion will drop and return to the ink reservoir (See the ink reservoir 1 in FIG. 16) through the return flow ports 55, 59 and 63, and the remaining mixture liquid having a relatively high moisture content proportion will be taken out to the outside of the ink circulation system through the liquid exhaust ports 56, 59 and 64 of the recovery containers 54, 58 and 62.

Now, a keyless printing press according to still another preferred embodiment of the present invention will be described with reference to FIGS. 9 to 12. In these figures, reference numeral 70 designates a delivery nozzle main body of a delivery nozzle, which delivery nozzle main body 70 is disposed in opposition to an ink source roller with a minute gap clearance maintained therebetween. Reference numeral 71 designates a cap for closing a top opening of the delivery nozzle main body 70, numeral 72 designates an inlet pipe provided at the bottom of one end portion of the delivery nozzle main body, numeral 73 designates a plurality of delivery ports provided in the front wall of the above-mentioned cap 71, and these respective delivery ports align in one row along the axial direction of the ink source roller. In addition, reference numeral 74 designates an ink outflow port provided in one end portion of the rear wall of the above-mentioned cap 71, numeral 78 designates another ink outflow port provided in the other end portion of the rear wall of the cap 71, numeral 82 designates a still another ink outflow port provided in the end wall at the other end of the cap 71, and these ink outflow ports 74, 78 and 82 are provided a level higher than any of the above-mentioned ink delivery ports 73. Reference numeral 75 designates a recovery container provided on the rear side of the above-mentioned cap 71 in opposition to the ink outflow port 74, numeral 76 designates a return flow port provided between the recovery container 75 and the ink outflow port 74 of the delivery nozzle main body 70, and numeral 77 designates a liquid exhaust port provided at the bottom of the recovery container 75. Also numeral 79 designates another recovery container provided on the rear side of the above-mentioned cap 71 in opposition to the ink outflow port 78, numeral 80 designates a return flow port provided between the recovery container 79 and the ink outflow port 78 of the delivery nozzle main body 70, and numeral 81 designates a liquid exhaust port provided at the bottom of the recovery container 79. Further numeral 83 designates a recovery container provided in the cap 71 opposed to the above-mentioned ink outflow port 82, numeral 84 designates a return flow port provided between the recovery container 83 and the ink outflow port 82 of the delivery nozzle main body 70, and numeral 85 designates a liquid exhaust port provided at the bottom of the recover container 83.

Next, the operations of the keyless printing press illustrated in FIGS. 9 to 12 will be explained in greater detail. A mixture liquid consisting of printing ink and isolated water flows from the inlet pipe 72 through the inside of the delivery nozzle main body 70 into the cap 71. At this time, since a mixture liquid having a high moisture content proportion occupies an upper layer while a mixture liquid having a low moisture content proportion occupies a lower layer, the mixture liquid having a low moisture content proportion will be delivered and fed through the respective delivery ports 73 towards the ink source roller, whereas the mixture liquid having a high moisture content proportion will flow out into the recovery containers 75, 79 and 83 through the ink outflow port 74 at one end portion and the ink outflow ports 78 and 82 at the other end portion. Furthermore, among the mixture liquid having a high moisture content proportion which flows out into the recovery containers 75, 79 and 83, a mixture liquid having a relatively low moisture content proportion will drop and return to an ink reservoir (See the ink reservoir 1 in FIG. 16) through the return flow ports 76, 80 and 84, and the remaining mixture liquid having a relatively high moisture content proportion will be taken out to the outside of the ink circulation system through the liquid exhaust ports 77, 81 and 85, respectively, of the recovery containers 75, 79 and 83.

As will be apparent from the above description, in the keyless printing press according to the present invention, owing to the fact that when a mixture liquid consisting of printing ink and isolated water has flowed into a delivery nozzle, a mixture liquid having a high moisture content proportion occupies an upper layer while a mixture liquid having a low moisture content proportion occupies a lower layer. The mixture liquid having a low moisture content proportion will be delivered and fed through the respective delivery ports towards the ink source roller, whereas the mixture liquid having a high moisture content proportion will flow out into the recovery containers through the ink outflow ports. Accordingly, it will never occur that isolated water repeatedly circulates through the ink circulation system and successively accumulates. Thus, there is an advantage that lowering of a printing depth can be prevented.

While a principle of the present invention has been described above in connection with a number of preferred embodiments of the invention, it is intended that all matter contained in the specification and illustrated in the accompanying drawings shall be interpreted to be illustrative and not as a limitation to the scope of the invention.

What is claimes is:

1. In a keyless printign press including an ink source roller, a closed and pressurized delivery nozzle disposed in opposition to said ink source roller and provided with a plurality of delivery ports aligned in a direction parallel to the axial direction of said ink source roller, and an ink circulation system for circulating a mixture of printing ink and water under pressure into said delivery nozzle and through said delivery ports onto said ink source roller, the improvement comprising means for while a portion of the mixture containing an acceptable proportion of water is discharged through said delivery ports onto said ink source roller, simultaneously ensuring that a portion of the mixture including an excessive proportion of water will be discharged from said delivery nozzle without being discharged onto said ink source roller, said means comprising:

at least one outflow port provided in said delivery nozzle at a level higher than any of said delivery ports and directed in a direction other than toward said ink source roller;

whereby said circulation system will discharge a portion of the mixture with a lesser proportion of water from a lower portion of the interior of said delivery nozzle through said delivery ports onto said ink source roller and will discharge the portion of the mixture with the excessive proportion of water from an upper portion of said interior of said delivery nozzle through said at least one outflow port away from said ink source roller.

2. The improvement claimed in claim 1, including a plurality of said outflow ports.

3. The improvement claimed in claim 1, wherein said plurality of outflow ports comprise outflow ports located centrally and at opposite ends of a rear wall of said delivery nozzle facing away from said ink source roller.

4. The improvement claimed in claim 3, wherein said plurality of outflow ports further comprise outflow ports located in opposite end walls of said delivery nozzle.

5. The improvement claimed in claim 2, wherein said plurality of outflow ports comprise outflow ports located at opposite ends of a rear wall of said delivery nozzle facing away from said ink source roller, and an outflow port located in one end wall of said delivery nozzle.

6. The improvement claimed in claim 1, further comprising a recovery container located outwardly of said delivery nozzle opposite said outflow port for recovering a water-rich part of the mixture portion discharged through said outflow port.

7. The improvement claimed in claim 6, further comprising a return port, located at a position between said outflow port and said recovery container, for returning to said circulation system a part of the mixture portion discharged through said outflow port that contains less water than the water-rich part recovered by said recovery container.

8. In a closed and pressurized delivery nozzle to be disposed in opposition to an ink source roller of a keyless printing press, said delivery nozzle having a plurality of delivery ports aligned in a direction to be parallel to the axial direction of the ink source roller, the keyless printing press to include an ink circulation system for circulating a mixture of printing ink and water under pressure into said delivery nozzle and through said delivery ports onto the ink source roller, the improvement comprising means for, while a portion of the mixture containing an acceptable proportion of water is discharged through said delivery ports onto the ink source roller, simultaneously ensuring that a portion of the mixture including an excessive proportion of water will be discharged from said delivery nozzle without being discharged onto the ink source roller, said means comprising:

at least one outflow port provided in said delivery nozzle at a level to be higher than any of said delivery ports and directed in a direction other than to be toward the ink source roller;

whereby the circulation system will discharge a portion of the mixture with a lesser proportion of water form a lower portion of the interior of said delivery nozzle through said delivery ports onto the ink source roller and will discharge the portion of the mixture with the excessive proportion of water from an upper portion of said interior of said delivery nozzle through said at least one outflow port in a direction to be away from the ink source roller.

9. The improvement claimed in claim 8, including a plurality of said outflow ports.

10. The improvement claimed in claim 9, wherein said plurality of outflow ports comprise outflow ports located centrally and at opposite ends of a rear wall of said delivery nozzle to be faced away from the ink source roller.

11. The improvement claimed in claim 10, wherein said plurality of outflow ports further comprise outflow ports located in opposite end walls of said delivery nozzle.

12. The improvement claimed in claim 9, wherein said plurality of outflow ports comprise outflow ports located at opposite ends of a rear wall of said delivery nozzle to be faced away from the ink source roller, and an outflow port located in one end wall of said delivery nozzle.

13. The improvement claimed in claim 8, further comprising a recovery container located outwardly of said delivery nozzle opposite said outflow port for recovering a water-rich part of the mixture portion discharged through said outflow port.

14. The improvement claimed in claim 13, further comprising a return port, located at a position between said outflow port and said recovery container, for returning to the circulation system a part of the mixture portion discharged through said outflow port that contains less water than the water-rich part recovered by said recovery container.

* * * * *